United States Patent [19]

Kelly et al.

[11] Patent Number: 5,061,352

[45] Date of Patent: Oct. 29, 1991

[54] ELECTROLYTIC ETCHING OF METALS TO REVEAL INTERNAL QUALITY

[75] Inventors: John H. Kelly, Burlington; Leonard E. Guest, Binbrook, both of Canada

[73] Assignee: Stelco Inc., Hamilton, Canada

[21] Appl. No.: 519,394

[22] Filed: May 4, 1990

[30] Foreign Application Priority Data

Jun. 5, 1989 [CA] Canada ..... 601708

[51] Int. Cl.[5] ..... C25F 3/06; C25F 3/16

[52] U.S. Cl. ..... 204/129; 204/129.35; 204/129.75; 204/141.5

[58] Field of Search ..... 204/129.1, 129.2, 129.35, 204/153.1, 224 M, 129, 141.5; 436/78

[56] References Cited

U.S. PATENT DOCUMENTS 2,745,805 5/1956 Jones, Jr. ..... 204/224 M X 4,533,642 8/1985 Kelly ..... 436/78

4,718,992 1/1988 Funahashi et al. ..... 436/78 X

*Primary Examiner*—Donald R. Valentine

*Attorney, Agent, or Firm*—Sim & McBurney

[57] ABSTRACT

The internal quality of continuously cast and other steel samples in the form of ingots, billets, blooms, slabs and bars is determined in rapid manner to enable potentially problem-causing casting conditions to be identified and corrected in timely manner. A steel sample from the casting, after grinding to remove any heat-affected zone and to provide a desired degree of surface roughness, is anodically etched using dilute hydrochloric acid at ambient temperature to etch away metal from the surface to reveal the internal quality. After removal of the sample from the etching apparatus, the sample is washed, dried, and visually examined to determine the internal quality.

20 Claims, 2 Drawing Sheets

ELECTROLYTIC ETCHING OF METALS TO REVEAL INTERNAL QUALITY

FIELD OF INVENTION

The present invention relates to an electrolytic procedure for the etching of metal pieces, particularly continuously-cast metal pieces, to reveal the internal quality of the metal piece.

BACKGROUND TO THE INVENTION

In the continuous casting of steel products, which may be in the form of a billet, bloom or slab, molten steel is delivered to the upper end of a vertical casting mold of the dimensions desired for the product. As the steel descends in the mold, it commences to solidify from the exterior towards the interior. While still in a pliable state, the solidifying steel is guided through a curved path to a horizontal direction.

The operating characteristics of the continuous casting procedure need to be known and under close control to maintain safe, efficient continuous casting. Process control is verified by evaluating the internal quality in at least the cross-section and at other times the longitudinal section of the cast steel. Steel is considered to have satisfactory internal structure if there are no internal cracks, no internal voids, no internal porosity, no inclusions and internal symmetry of zones of solidification.

Immediately after the product is solid, a sample can be cut from the cross-section and, after surface preparation, the sample is tested by either or each of two conventional methods, namely sulphur printing or acid etching. If the sulfur content of the steel is less than 0.010% S or deoxidized with aluminum, only the acid etching method is workable.

Existing acid etching procedures are time consuming and unreliable in providing a rapid processing of a steel sample to reveal its internal quality. Such acid etching (ASTM Standard E381-79) generally involves selective attack on the metal surface by an aqueous acid solution comprising 1 to 1 v/v technical grade hydrochloric acid at about 70° to 80° C. for longer than about 20 minutes, the time depending on the initial temperature of the metal, followed by visual inspection of the etched surface.

Electrochemical etching and electropolishing of small metal specimens is part of the existing art of chemical analysis and metallography. For example, U.S. Pat. No. 4,533,642, assigned to the assignee hereof, describes an electrolytic etching procedure for determining the acid-soluble aluminum content of small steel samples. This procedure employs small quantities of steel to determine the specific content of aluminum by chemical analysis of the spent etchant. The electrolytic etching of large scale metal samples does not appear to have been practiced previously and not for the purpose of determining the internal quality of a steel sample, as is effected herein.

SUMMARY OF INVENTION

In accordance with the present invention, there is provided a novel method of etching metal pieces to reveal their internal quality by using electrolytic procedures, which provides a rapid, readily-controlled, safe and environmentally-acceptable operation at ambient temperatures.

Accordingly, in one aspect of the present invention, there is provided a method of determining the internal quality of a steel ingot, slab, bloom, billet and/or bar, which comprises a plurality of sequential operations. A sample first is removed from the steel by any convenient procedure and the surface to be examined is milled to remove any heat-affected zone and preferably to provide a surface having a peak-to-valley surface roughness ($R_Z$) of less than about 6.8 um. The milled surface then is electrolytically etched using an aqueous etchant, usually an aqueous acid etchant to remove at least about 1 mil (about 25 um) of steel from the surface of the sample so as to expose a surface representative of the internal quality of the steel ingot, slab, bloom, billet and/or bar from which the sample was taken. The etched surface of the sample then is treated to remove aqueous etchant and any deposit therefrom and then dried. The dried etched surface then is visually examined for its internal quality.

Figure 1:
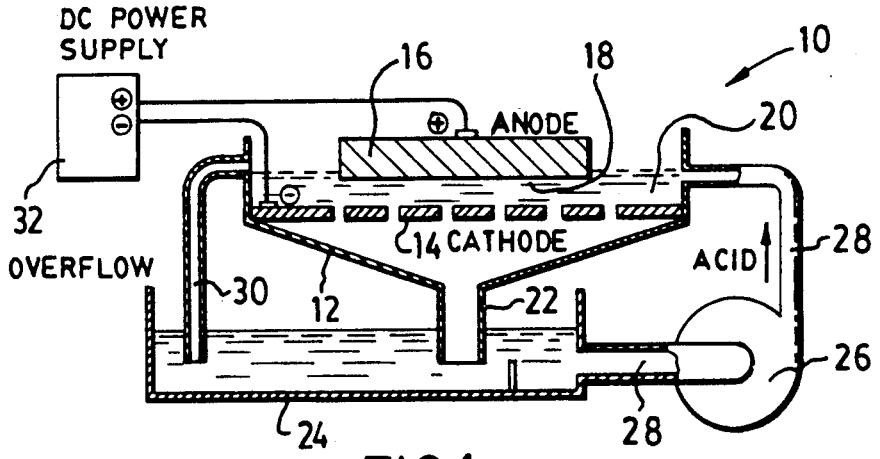
FIG. 1 is a schematic illustration of one form of electrolytic etching apparatus useful in the present invention for the treatment of billets and small samples wherein stationary electrodes are employed.

The present invention is broadly applicable to the determination of the internal quality of steel at a particular plane within the steel. The determination may be made for either the transverse or longitudinal plane of continuously cast or ingot cast metals or of hot-or cold-rolled metals.

Samples for treatment and examination by the method of the invention may be cut from the transverse or longitudinal planes of ingots, blooms, slabs, billets or bars. However, ingots usually are rarely studied and then only at the time of introducing a new mold design or a new grade of steel. Continuously-cast blooms, slabs and billets usually are routinely tested and hot-rolled blooms, slabs and billets sometimes may be tested. All such test operations when desired to be carried out may be effected by the method of the present invention.

The procedure of the present invention particularly involves analysis of steel slabs, blooms and billets formed by the continuous casting of steel for the internal quality of the steel. A sample for testing is removed from the steel in any convenient manner and is milled to a depth which removes any heat-affected zone in the surface of the metal and provides a surface having a peak-to-valley roughness of less than about 6.8 um. Such heat-affected zone initially may be absent from the sample, depending on the procedure employed to form the sample, and the sample may have the desired surface roughness in which case the milling step may be omitted. In each case, a sample is cut from an end of the steel, for example, approximately 1½ to 2 inches from the end, and, in the case of bloom and slab samples, the sample is further subdivided into manageable pieces for further processing.

Steel then is electrolytically etched from the milled surface using an aqueous acid etchant to reveal the internal quality.

It is essential in the present invention to remove at least about 1 mil (i.e., at least 1 one-thousandths of an inch or about 25 um) and generally up to about 6 mils (about 150 um) of steel from the milled sample in order satisfactorily to reveal the internal quality of the steel sample. It is noted that this quantity of metal removed contrasts markedly with that involved in etching small steel samples to determine the aluminum content thereof, where only a small amount of steel needs to be dissolved to make the analytical determination of aluminum content of the steel sample and, in fact, the removal of large quantities of metal seriously impairs the analytical process. In the process of the invention, a significant depth of metal must be removed from the milled surface of the sample to expose the internal quality of the sample.

The steel sample is the anode during the etching and is positioned adjacent to and closely spaced from a suitable cathode while an electric current is passed between the two through a suitable aqueous acid etchant or electrolyte.

Anodic electrolytic etching produces hydrogen bubbles at the cathode. The hydrogen bubbles displace the electrolyte and cause non-uniformity of current density and hence a non-uniform rate of removal of metal from the anode. In addition, if still acid is used, the electrolyte becomes depleted of acid at the metal surface and insoluble hydrated metal oxide forms, which tends to inhibit further metal removal.

Accordingly, in the present invention, the anodic dissolution is effected in such manner as to displace the hydrogen bubbles from the current path and to rapidly move the reaction products away from the metal surface. Generally, this is achieved by circulating electrolyte through the space between the anode and cathode at any convenient recirculation rate, generally about 10 to about 60L/min of acid etchant, to achieve a flushing action.

With smaller metal samples, for example, a 4"×4" billet slice, it is convenient to provide the anode and cathode stationary with respect to one another during the electrolysis. In this arrangement, it is preferred to employ a perforated plate cathode to facilitate circulation of electrolyte through the gap between the anode and cathode to achieve the desired flushing action to remove gaseous hydrogen and reaction products. This arrangement is not satisfactory for larger metal samples, for example, 8"×13" for a bloom slice or 9½"×12" for a slab slice, since hydrogen tends to hang up under the center of the sample. The perforated cathode may be located below or above the anodic sample in a bath of electrolyte. Provision is made for recirculation of electrolyte between the bath and the gap between anode and cathode.

With larger metal samples, such as those taken from blooms and slabs, it is advantageous to provide relative linear motion between the anodic sample and the cathode while the anode and cathode remain spaced the same distance apart. This operation also may be employed with ingot, billet and rod slices, if desired. In this arrangement, the cathode preferably is in the form of an elongate tubular rod having a slit extending the length thereof to facilitate circulation of electrolyte through the gap between the anode and cathode to achieve the desired flushing action. In addition, the combination of an elongate tubular cathode and relative linear movement of anode and cathode permits a much higher local current density to be applied to a portion of the surface of the anodic sample for the same average current density, so that dissolution of metal can be effected uniformly.

The tubular cathode may be moved above a stationary anodic sample immersed in electrolyte, or the anodic sample may be moved above the tubular cathode, which is maintained stationary. Provision in either case is made for recirculation of electrolyte between the electrolyte bath and the interior of the tubular cathode. The relative motion between anode and cathode is such that the whole surface of the anodic sample is traversed, so that a uniform quantity of steel is etched from the surface. The electrochemical conditions and speed of relative movement may be such as to complete the desired dissolution in one pass, or in a single reciprocal pass or in multiple passes.

The electrolytic etching is effected to remove steel from the anode surface in an amount sufficient to expose a representative internal quality. As noted above, a minimum of about 1 mil of steel is required to be removed from the sample. Once the internal quality has been exposed by anodic dissolution, further etching does not reveal any new information. Generally, about 2 to about 5 mils (about 50 to about 125 um) of steel are removed during the etching step.

The electrolytic conditions required to effect the desired degree of etching depend to some extent upon the etchant employed, the procedure employed to effect the etching and the size of the sample employed. Generally, the electrolytic etching is carried out using a current of about 200 to about 1200 amps applied at an effective current density of about 4 to about 24 amp/cm$^2$. The effective current density also is tied to the recirculation rate of the acid ethchant, with the rate of acid recirculation rate to effective current density generally ranging from about 1 to about 6.

The electrolytic etching generally is effected using dilute hydrochloric acid, usually having a concentration of about 10 to about 30% v/v technical grade HCl, at net ambient temperatures, usually from about 10° to about 40° C. The desired degree of etching generally is complete in about 1 to about 6 minutes. Other convenient dilute aqueous etchants which are activated by electric current may be used, if desired.

The electrolytic etching of the steel to remove metal from the surface desired to be inspected tends to cause a black gelatinous coating or precipitate to form over the steel surface. This coating, however, is readily removed in subsequent processing.

After the etched sample is removed from the etching apparatus, the sample is rinsed with water, rubbed vigorously with cleansing powder to remove the coating, if present, from the etched surface, followed by rinsing and drying with an air gun. A clear acrylic resin coating may be applied to the etched surface to protect it against oxidation. The sample then can be studied visually for the internal quality condition of the sample.

In addition, rather than rinsing the etched surface completely, an alkaline rinse first may be effected to neutralize trapped acid sites in hairline cracks and small holes in the etched surface, so that darkly colored hydrated iron oxide forms and is more readily seen visually, thereby facilitating identification of the internal quality.

Some steels contain relatively high levels of copper, for example, 0.30 wt. % instead of a more normal approximately 0.03 wt. % Cu. When electrolytic action is effected on a sample of such steel in accordance with the present invention, copper also goes into solution and some of the copper may become deposited on the cathode. When the current is turned off, the cathode preferably is moved away from the etched sample far enough so that deposited copper is not transferred from the cathode to the nearest portion of the etched sample. A sacrificial steel bar may be placed adjacent the cathode to avoid the sample becoming contaminated by copper.

The same electrolyte bath is employed for a number of successive etchings. During such successive anodic etchings, there is a build up of solubilized iron in the bath of electrolyte and a depletion of the effectiveness of the acid. The electrolyte requires replacement from time to time as it becomes depleted in this way. The replacement should be made before all the free acid in the etchant bath is used up, otherwise insolubilized hydrated iron oxide may form along with copper staining of the sample surface.

The decision as to when to replace the depleted electrolyte may be based on any convenient basis, for example, a measurement of the total time for which the electrolyte has been employed. Alteratively, where the cell geometry is constant, the cell voltage may be measured and depleted electrolyte may be replaced when the cell voltage has increased to a predetermined level, for example, a voltage of 12 volts increasing to 24 volts.

Since the internal quality of the sample can be rapidly determined by the present invention, any irregularities that examination of the internal quality reveals can be communicated to the operating staff for any adjustment required to the operating conditions for the particular steel-making operation in respect of which the test has been carried out, for example, the operator of a continuous caster.

In comparison to the conventional hot acid etching procedure for exposing internal quality, the present invention exhibits certain advantages. Since a cold dilute hydrochloric acid is employed in the present invention, fume formation at elevated temperatures and the safety hazard of hot strong hydrochloric acid associated with the prior art procedure are avoided. Further, since hydrogen is generated only at a desired surface, namely the cathode, and not from the sample itself, as opposed to the prior art where hydrogen is generated from the whole sample, there is less potential for the formation of explosive gas mixtures.

In addition, the speed of reaction of the electrolytic process employed herein is dependent mainly on current density whereas with the prior art hot the acid etch process is very much temperature dependent.

DESCRIPTION OF PREFERRED EMBODIMENT

Referring to the drawings, FIG. 1 illustrates one form of etching apparatus 10 having an etching vessel 12 which has a fixed perforated cathode 14 extending across the base of the vessel and an anode 16 comprising the sample to be etched spaced apart a short distance from the cathode to define a gap 18 therebetween.

A bath 20 of dilute hydrochloric acid is located in the vessel 12. The etching vessel 12 communicates at its lower end with a pipe 22 which permits dilute hydrochloric acid in the bath 20 to flow into a lower etchant reservoir vessel 24. A recirculation pump 26 communicates through pipes 28 with the etchant reservoir 24 and the etching vessel 12 to recirculate the acid from the reservoir 24 to the vessel 12.

The vessel 12 is provided with an overflow pipe 30 to maintain a constant level of acid in the vessel 12 during the etching operation.

In operation, the acid is circulated between the reservoir 24 and the vessel 12 by the recirculation pump 26 to provide a level of acid below the overflow level. The sample 16 then is positioned in the vessel 12 so that the surface to be etched is below the acid level and is spaced from the cathode 14 by the gap 18.

An electric current then is applied from a power source 32 between the cathode and anode while the acid bath is circulated. Metal is etched from the anode sample 16 and hydrogen is formed at the cathode. The circulation rate of the acid is such as to flush the hydrogen out of the gap 18 so as to prevent gas building at the anode and permit uniform etching. The flushed-out hydrogen is vented from the vessel 12. The perforated form of the cathode 14 permits the electrolyte to circulate.

When the desired degree of etching has been effected, the current is turned off, circulation of the acid ceased and the metal sample 16 removed. The apparatus of FIG. 1 is suitable only for billet samples of about 4 to 6 inches square, since hydrogen tends to accumulate near the center of the section with large-sized samples.

Figure 2:
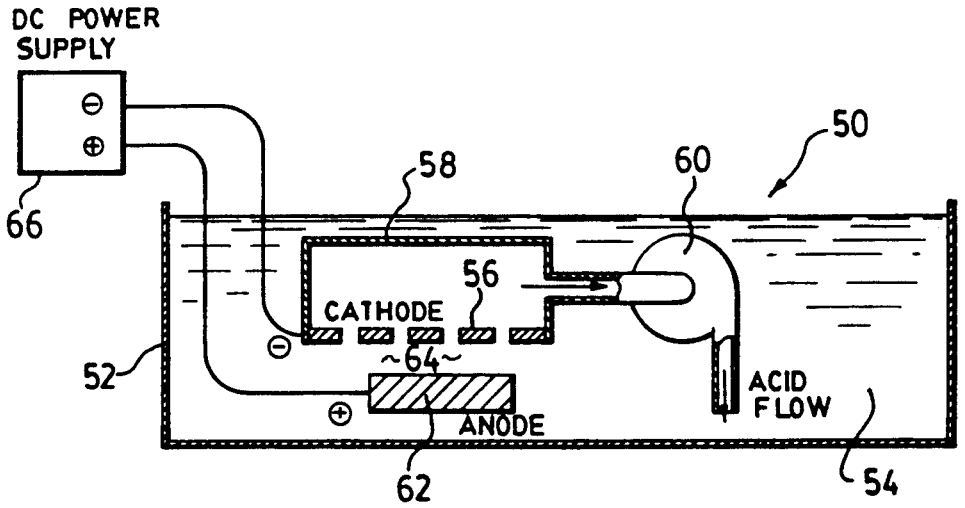
FIG. 2 is a schematic illustration of an alternative form of electrolytic etching apparatus to that illustrated in FIG. 1.

The arrangement of FIG. 2 is an alternative to that of FIG. 1. As seen therein, the apparatus 50 comprises a single tank 52 containing a bath 54 of acid etchant. A perforated cathode 56 communicates with a submerged vessel 58 which, in turn, communicates with a recirculation pump 60 for the recirculation of etchant from the bath 54.

A steel sample 62 is positioned immersed in the bath 54 below and spaced from the cathode 56 by a gap 64. Electrical current is applied between the anodic sample 62 and the cathode 56 by a suitable power source 66, while the electrolyte is circulated.

The apparatus of FIG. 2 is inconvenient except for smaller samples but may be employed with such samples to effect rapid etching of the surface to be inspected.

In the embodiments of FIGS. 1 and 2, the sample is maintained in a fixed position relative to the cathode during etching and the whole of the surface of sample is in contact with the circulating bath. It is preferred, however, to employ relative movement between anode and cathode and exposure of part only of the sample to circulating electrolyte at any given time. The latter arrangement enables much higher instantaneous current densities to be employed and hence rapid metal removal to be effected. With larger bloom and slab samples, this arrangement avoids the hydrogen accumulation problem mentioned above.

Figure 3:
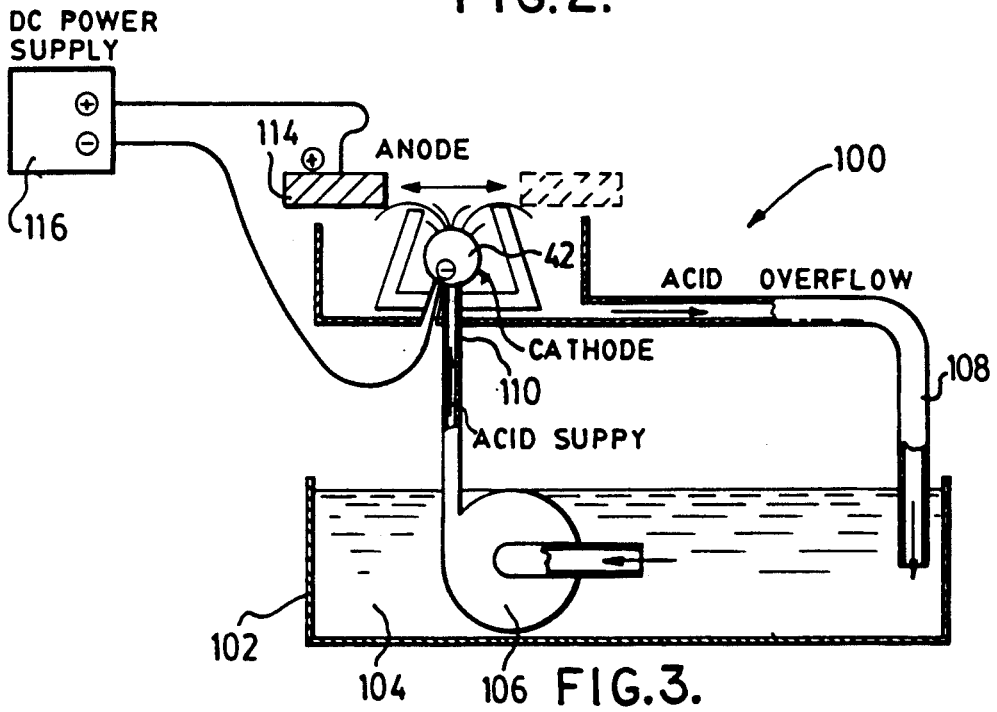
FIG. 3 is a schematic illustration of one form of electrolytic etching apparatus for bloom and slab samples wherein the anode moves relative to the cathode.
Figure 4:
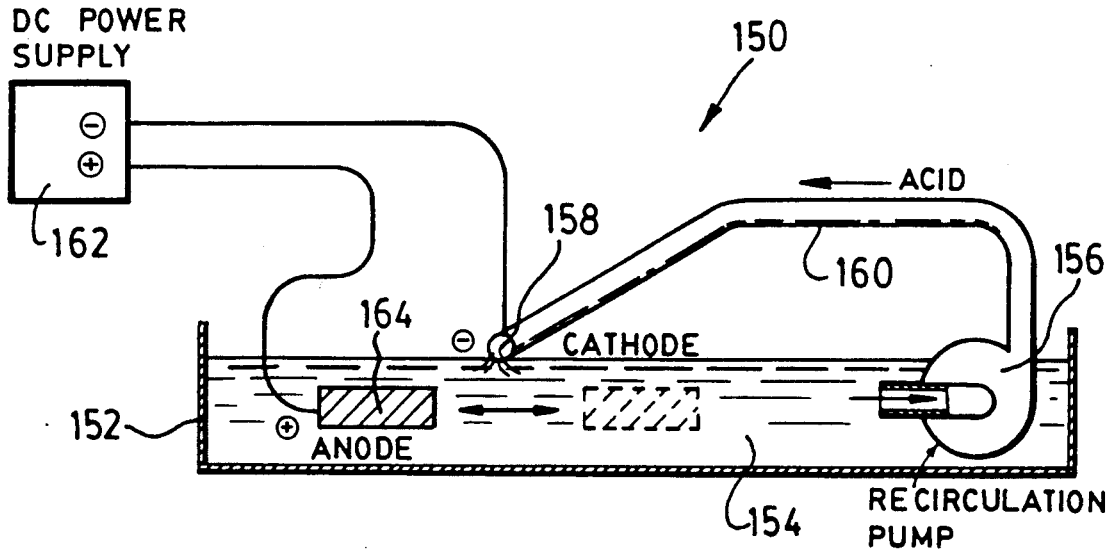
FIG. 4 is a schematic illustration of an alternative form of electrolytic etching apparatus for bloom and slab samples to that illustrated in FIG. 3.

One embodiment of such apparatus useful for bloom and slab samples, but which also may be used for billet samples, is shown in FIG. 3 while another embodiment of such apparatus also useful for bloom and slab slices, which are more conveniently handled by total immersion in acid, is shown in FIG. 4.

In FIG. 3, the etching apparatus 100 comprises a reservoir tank 102 in which a reservoir 104 of etchant acid is housed. A recirculating pump 106 communicates with the etchant reservoir 104 as does a return acid overflow pipe 108.

The recirculating pump 106 communicates by pipe 110 with an acid spray nozzle 112 which is in the form of an elongate tube and acts as a cathode. A sample 114 to be etched is gripped by a suitable mechanism, which also may be employed to make the electrical connection thereto , for movement relative to the cathode 112.

An electrical power source 116 applies an electric current between the anode and cathode while the anodic sample 114 is moved linearly relative to the cathode 112, which sprays acid against the portion of the sample 114 adjacent to the spray. In this way, etching occurs only at a small area of the sample at any given time. The spacing between the anodic sample 114 and the cathode 112 is maintained constant during the relative movement to ensure uniform etching. The etching may be effected in a single pass or in a reciprocal pass (i.e., etching occurs on both a forward and a reverse pass). Spent etchant returns to the reservoir 104 via the overflow pipe 108. Since only a small area of the sample 114 is exposed to electrolyte at one time, much higher instantaneous current densities are possible.

Although the anode sample 114 is shown moving relative to the stationary cathode 112 in FIG. 3, obviously the same effect can be obtained by moving the cathode 112 relative to a stationary anode 114.

In FIG. 4, the apparatus 150 comprises a tank 152 containing an acid etchant bath 154 having a recirculation pump 156 communicating between the bath 154 and an elongate spray head 158 through pipe 160. The spray head 158 is connected to a power supply 162 as the cathode.

A sample 164 is connected to the power supply 162 to be the anode and is moved relative to the spray head 158, or, alternatively, the spray head 158 may be moved relative to the sample 164. As in the case of the embodiment of FIG. 3, the spacing is maintained constant during the relative movement of spray head 158 and sample 164. In addition, etching may be completed in a single pass or in a reciprocal pass.

The etching procedure for the FIG. 4 embodiment may be automated for heavy slab or bloom slices to effect the following mechanical motions, namely manually placing the slice facing upwards on an elevator support, lowering the slice into the tank, filling the tank with electrolyte, slowly moving the cathode tube or the slice while the power is on, during which time the electrolyte is rapidly pumped across the sample face, either through openings in the tube-like cathode or from an adjacent array of nozzles, to effect the desired degree of etching and raising the sample from the tank after the current has been turned off.

Figure 5:
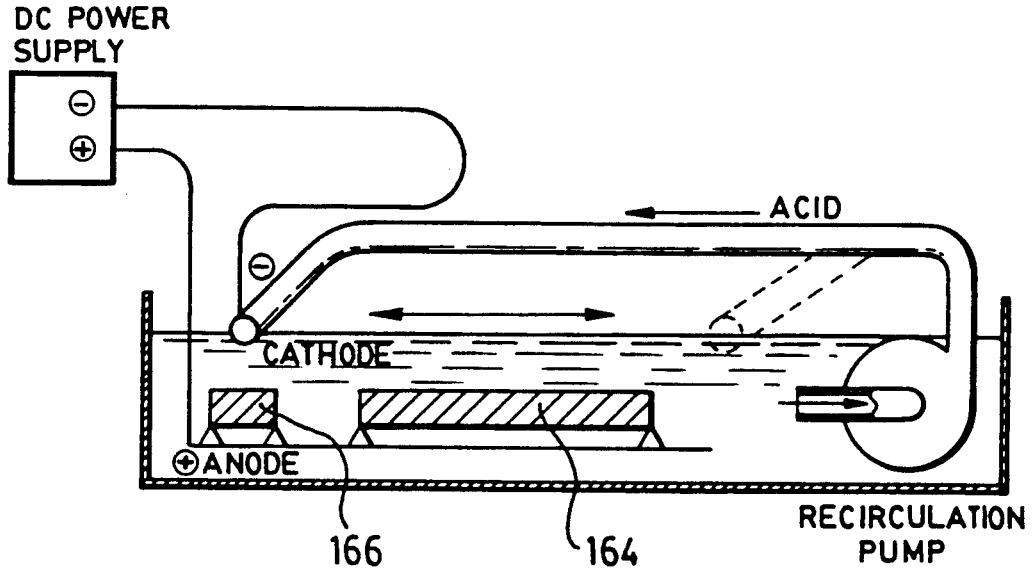
FIG. 5 is a schematic representation of a further alternative form of electrolytic etching apparatus for bloom and slab samples using a sacrificial steel bar for high copper steels.

FIG. 5 is similar to FIG. 4, except that it employs a sacrificial steel bar 166, to prevent deposition of copper on the steel sample 164 when etching high copper content steels, such as may occur when the current is turned off, such copper instead being deposited on the steel bar 166.

Following the dissolution of the metal from the desired surface in the apparatus of any one of FIGS. 1 to 5, the metal sample is removed from the electrolytic apparatus, washed, scrubbed, dried and then visually inspected for internal quality.

EXAMPLE

The apparatus of FIG. 4 was employed to effect anodic dissolution of steel from samples taken from continuously cast billets, blooms and slabs and certain parameters were measured and determined. This data then was tabulated and compared to corresponding typical parameters of the acid etching employed in the rapid acid soluble aluminum determination procedure described in the aforementioned U.S. Pat. No. 4,533,642 using cold dilute acid, that same aluminum determination procedure as carried out with hot acid and the parameters typically employed for the conventional hot acid etch procedure for revealing internal quality.

The results obtained are set forth in the following Table:

TABLE

COMPARISON OF HOT ACID AND ELECTROLYSIS FOR STEEL DISSOLUTION

| | | Steel Dissolution by Conventional Hot Acid | | | | Steel Dissolution by Cold Dilute Acid Using Electrolysis | | | |
|---|---|---|---|---|---|---|---|---|---|
| No. | Parameter | Acid Soluble Aluminum Determination | Slab | Bloom | Billet | Acid Soluble Aluminum Determination | Slab | Bloom | Billet |
| 1. | SAMPLE | | | | | | | | |
| | Size before cutting mm | 32 × 38 | 240 × 2032 | 330 × 610 | 100 × 100 | 32 × 38 | 240 × 2032 | 330 × 610 | 100 × 100 |
| | Size after cutting | | 240 × 300 | 330 × 200 | | | 240 × 300 | 330 × 200 | |
| | Thickness mm | 6 | 50 | 50 | 64 | 6 | 50 | 50 | 64 |
| | Face area $cm^2$ | 10 | 720 | 660 | 100 | 10 | 720 | 660 | 100 |
| | Weight kg | .047 | 28 | 26 | 4.99 | .047 | 28 | 26 | 4.99 |
| 2. | TANK CAPACITY | | | | | | | | |
| | Sample size (max) | (0.5 g) Chips | 330 × 330 × 70 | 330 × 330 × 70 | 150 × 150 × 100 | 380 × 6 (round sample) | 330 × 330 × 70 | 330 × 330 × 70 | 150 × 150 × 100 |
| | Tank Size-L | 0.10 | 30 | 30 | 10 | 0.02 | 10 | 10 | 3 |
| | Reservoir Size-L | 10 | 30 | 30 | 10 | 10 | 180 | 180 | 90 |
| 3. | STEEL DISSOLVED | | | | | | | | |
| | Weight-g | 0.5 | 64.82 | 64.82 | 10.42 | .0926 | 32.41 | 32.41 | 5.21 |
| | Thickness-um | (Chips) | 58 × 2 | 63 × 2 | 67 × 2 | 12 | 58 | 63 | 67 |
| 4. | HCl USED PER SAMPLE | | | | | | | | |
| | Weight-HCl-g | 0.65 | 85 | 85 | 13.6 | 0.121 | 42 | 42 | 6.8 |
| 5. | COULOMBS PER SAMPLE | | | | | | | | |
| | (amp × sec) | | | | | 320 (16 × 20) | 112,000 (350 × | 112,000 (350 × | 18,000 (200 × 90) |

TABLE-continued

COMPARISON OF HOT ACID AND ELECTROLYSIS FOR STEEL DISSOLUTION

| | | Steel Dissolution by Conventional Hot Acid | | | | Steel Dissolution by Cold Dilute Acid Using Electrolysis | | | |
|---|---|---|---|---|---|---|---|---|---|
| No. | Parameter | Acid Soluble Aluminum Determination | Slab | Bloom | Billet | Acid Soluble Aluminum Determination | Slab | Bloom | Billet |
| | | | | | | | 320) | 320) | |
| 6. | HYDROGEN PER SAMPLE | | | | | | | | |
| | volume-ntp-l | 0.20 | 26 | 26 | 4.2 | 0.037 | 13 | 13 | 2.09 |
| 7. | ELAPSED TIME FOR DISSOLUTION | | | | | | | | |
| | approx. sec | 1200 | 1200 | 1300 | 1400 | 20 | 320 | 320 | 90 |
| 8. | MAX. NO. OF SAMPLES PER TANK OF ACID | 100 | 10 | 10 | 11 | 500 | 125 | 125 | 390 |
| 9. | MIN. REQUIRED SUPPLY AIR TO AVOID EXPLOSION | | | | | | | | |
| | -L/min | 0.073 | 27 | 27 | 36 | 2.2 | 50 | 50 | 28 |
| 10. | ACID 'RECIPE' (per tank) | | | | | | | | |
| | Tech.Grade-HCl-L | 5 | 15 | 15 | 5 | .0018 | 27.8 | 27.8 | 13.9 |
| | Makeup Water-L | 5 | 15 | 15 | 5 | .019 | 154. | 154. | 77 |
| 11. | SPENT ACID (per tank) | | | | | | | | |
| | Weight-HCl-g | 212 | 637 | 637 | 212 | .0765 | 1326 | 1326 | 663 |
| | Weight-$FeCl_2$-g | 3325 | 9974 | 9974 | 3325 | 1.197 | 9216 | 9216 | 4608 |
| | Concentration- | | | | | | | | |
| | HCl-g/L | 42.5 | 42.5 | 42.5 | 42.5 | .00765 | 7.3 | 7.3 | 7.3 |
| | $FeCl_2$-g/L | 665 | 665 | 665 | 665 | .1197 | 51. | 51. | 51. |
| 12. | ACID RECIRCULATION RATE-L/min | | | | | 0.5 | 23 | 23 | 23 |
| 13. | EFFECTIVE CURRENT DENSITY-amp/$cm^2$ | | | | | 1.60 | 4.66 | 4.17 | 7.87 |
| 14. | INDEX of Item 12 | | | | | 0.31 | 4.93 | 5.52 | 2.92 |
| | Item 13 | | | | | | | | |
| 15. | TEMPERATURE °C. | 71 to 82 | 71 to 82 | 71 to 82 | 71 to 82 | 10 to 40 | 10 to 40 | 10 to 40 | 10 to 40 |

As may be seen from the above Table, the procedure of the present invention contrasts markedly with the conventional hot acid etch procedures for internal quality determination and for acid soluble aluminum determination in the process conditions involved. The ability to employ near ambient temperatures eliminates the tendency to fume formation from the etchant.

In addition, the procedure of the present invention contrasts markedly with our electrolytic acid soluble aluminum determination procedure.

The samples treated in the two procedures are of entirely different sizes and the process conditions employed to effect, on the one hand, dissolution of iron and aluminum to determine aluminum content and, on the other hand, dissolution of iron to determine internal quality and results obtained by the two procedures are entirely different.

SUMMARY OF DISCLOSURE

In summary of this disclosure, the present invention provides a novel procedure for the determination of the internal quality of steel samples by a rapid room temperature electrolytic etching of the sample using dilute hydrochloric acid or other aqueous etchant. Modifications are possible within the scope of this invention.

What we claim is:

1. A method of determining the internal quality of a steel ingot slab, bloom, billet and/or bar, which comprises:

removing a sample from said steel, milling the surface of the sample to be examined to remove any heat-affected zone, electrolytically etching steel from said surface using an aqueous etchant which does not significantly react with steel in the absence of an electric current to remove at least about 1 mil (about 25 um) of steel from the surface of the sample so as to expose a surface representative of the internal quality of the steel ingot, slab, bloom, billet and/or bar from which the sample was taken, treating the etched surface of the sample to remove aqueous etchant and any deposit therefrom and drying the etched surface, and visually examining the etched surface of the sample for its internal quality.

2. A method of determining the internal quality of a steel ingot, slab, bloom, billet and/or bar, which comprises:

removing a sample from said steel, milling the surface of said sample to be examined to remove any heat affected zone to provide a surface having a peak-to-valley roughness ($R_Z$) of less than about 6.8 um, electrolytically etching steel from said surface using an aqueous etchant which does not significantly react with steel in the absence of an electric current to remove at least about 1 mil (about 25 um) of steel from the surface of the sample so as to expose a surface representative of the internal quality of the steel ingot, slab, bloom, billet and/or bar from which the sample was taken, treating the etched surface of the sample to remove aqueous etchant and any deposit therefrom and drying the etched surface, and visually examining the etched surface of the sample for its internal quality.

3. The method of claim 2 wherein about 2 to about 5 mils (about 50 to about 125 um) of steel are removed from said surface of the sample by electrolytic action.

4. The method of claim 3 wherein said electrolytic etching is carried out using about 200 to about 1200 amps of electrical power applied to the sample at an effective current density of about 4 to about 24 amps/cm$^2$.

5. The method of claim 3 wherein said electrolytic etching is effected using dilute hydrochloric acid having a concentration of about 10 to about 30 v/v technical grade HCl at a temperature of about 10° to about 40° C.

6. The method of claim 5 wherein said electrolytic etching is effected for about 1 to about 6 minutes.

7. The method of claim 6 wherein said sample is provided as said anode and is spaced from a cathode for said electrolytic etching, hydrogen produced at the cathode during said etching is displaced from between the anode and cathode and reaction products formed during said etching are rapidly moved away from the surface of said sample.

8. The method of claim 7 wherein said hydrogen displacement and removal of reaction products is effected by recirculating said aqueous etchant between said anode and cathode at a recirculation rate of about 10 to about 60L/min of etchant.

9. The method of claim 8 wherein the ratio of said recirculation rate to the effective current density applied to the anodic sample is about 1 to about 6.

10. The method of claim 9, wherein said sample is a billet sample, said cathode is in the form of a plate situated parallel to said sample, and said anode and cathode are maintained stationary relative to one another during said electrolytic etching.

11. The method of claim 10, wherein said cathode is perforated and electrolyte is circulated between said anode and cathode and through the perforated cathode to effect said hydrogen displacement and said reaction products removal.

12. The method of claim 9, wherein said cathode is in the form of an elongate tubular pipe extending transversely of the sample, and relative movement is effected between said anodic sample and said tubular cathode during said electrolytic etching such that the elongate tubular pipe transverse the whole of the surface to be etched while spaced a uniform distance from the anodic sample.

13. The method of claim 12, wherein electrolyte directing means is provided associated with said cathode for directing electrolyte onto the surface of said sample while an electric current is applied between the cathode and anode to effect said electrolytic dissolution, said hydrogen displacement and said reaction products removal.

14. The method of claim 13, wherein said sample is a slab sample or bloom sample and is immersed in a bath of electrolyte while said relative movement is affected.

15. The method of claim 1 wherein said etched surface is treated by washing to remove spent etchant and then removing any black gelatinous coating formed during said etching procedure.

16. A method of determining the internal quality of a steel ingot, slab, bloom, billet and/or bar, which comprises:

removing a sample from said steel, milling the surface of the sample to be examined to remove any heat-affected zone and to provide a surface having a peak-to-valley roughness ($R_Z$) of less than about 6.8 um, electrolytically etching about 2 to about 5 mils (about 50 to about 125 um) of steel from said surface using an aqueous etchant which does not significantly react with steel in the absence of an electric current using about 200 to about 1200 amps of electrical power applied to the sample at an effective current density of about 4 to about 24 amps/cm$^2$ to remove about 2 to about 5 mils (about 50 to about 125 um) of steel from the surface so as to expose a surface representative of the internal quality of the steel ingot, slab, bloom, billet and/or bar from which the sample was taken, treating said etched surface of the sample by washing to remove aqueous etchant and then removing any black gelatinous coating formed during said etching procedure and drying the etched surface, and visually examining the etched surface of the sample for its internal quality.

17. A method of determining the internal quality of a steel ingot slab, bloom, billet and/or bar, which comprises:

removing a sample from said steel, milling the surface of the sample to be examined to remove any heat-affected zone, and to provide a surface having a peak-to-valley roughness ($R_Z$) of less than about 6.8 um, electrolytically etching steel from said surface using dilute hydrochloric acid having a concentration of about 10 to about 30 v/v technical grade HCl at a temperature of about 10° to about 40° C. for about 1 to about 6 minutes to remove about 2 to about 5 mils (about 50 to about 125 um) from the surface of the sample so as to expose a surface representative of the internal quality of the steel ingot, slab, bloom, billet and/or bar from which the sample was taken, said sample being provided as said anode and being spaced from a cathode for said electrolytic etching, displacing hydrogen produced at the cathode during said etching from between the anode and cathode and rapidly removing reaction products formed during said etching from the surface of said sample by recirculating said aqueous etchant between said anode and cathode at a recirculation rate of about 10 to about 60L/min of etching and treating said etched surface of the sample to remove spent aqueous etchant and then removing any black gelatinous coating formed during said etching procedure, and drying the etched surface, and visually examining the etched surface of the sample for its internal quality.

18. A method of determining the internal quality of a steel ingot slab, bloom, billet and/or bar, which comprises:

removing a sample from said steel, milling the surface of the sample to be examined to remove any heat-affected zone, electrolytically etching steel from said surface using an aqueous etchant which does not significantly react with steel in the absence of an electric current to remove at least about 1 mil (about 25 um) of steel from the surface of the sample so as to expose a surface representative of the internal quality of the steel ingot, slab, bloom, billet and/or bar from which the sample was taken, following said etching step, subjecting said etched surface to an alkaline rinse to neutralize trapped acid sites in the surface, so as to form darkly-colored hydrated iron oxide which can be readily observed visually, facilitating identification of the internal quality of the steel sample, drying the etched surface, and visually examining the etched surface of the sample for its internal quality.

19. A method of determining the internal quality of a steel ingot slab, bloom, billet and/or bar, which comprises:

removing a sample from said steel, milling the surface of the sample to be examined to remove any heat-affected zone and to provide a surface having a peak-to-valley roughens ($R_Z$) of less than about 6.8 um, electrolytically etching steel from said surface using an aqueous etchant which does not significantly react with steel in the absence of an electric current using about 200 to about 1200 amps of electrical power applied to the sample at an effective current density of about 4 to about 24 amps/cm$^2$, to remove about 2 to about 6 mils (about 50 to about 125 um) of steel from said surface of the sample by electrolytic action so as to expose a surface representative of the internal quality of the steel ingot, slab, bloom, billet and/or bar from which the sample was taken, following said etching step, subjecting said etched surface to an alkaline rinse to neutralize trapped acid sites in the surface, so as to form darkly-colored hydrated iron oxide which can be readily observed visually, facilitating identification of the internal quality of the steel sample, drying the etched surface, and visually examining the etched surface of the sample for its internal quality.

20. A method of determining the internal quality of a steel ingot slab, bloom, billet and/or bar, which comprises:

removing a sample from said steel, milling the surface of the sample to be examined to removed any heat-affected zone, and to provide a surface having a peak-to-valley roughness ($R_Z$) of less than about 6.8 um, electrolytically etching steel from said surface using dilute hydrochloric acid having a concentration of about 10 to about 30 v/v technical grade HCl at a temperature of about 10° to about 40° C. for about 1 to about 6 minutes to remove about 2 to about 5 mils (about 50 to about 125 um) from the surface of the sample so as to expose a surface representative of the internal quality of the steel ingot, slab, bloom, billet and/or bar from which the sample was taken, following said etching step, subjecting said etched surface to an alkaline rinse to neutralize trapped acid sites in the surface, so as to form darkly-colored hydrated iron oxide which can be readily observed visually, facilitating identification of the internal quality of the steel sample, drying the etched surface, and visually examining the etched surface of the sample for its internal quality.

* * * * *